United States Patent [19]

Morris et al.

[11] Patent Number: 4,978,030

[45] Date of Patent: Dec. 18, 1990

[54] CANDY DISPENSER

[76] Inventors: Arleen Morris; Clarence D. Simpson, both of 409 Palm Ave. #C 31, Imperial Beach, Calif. 92032

[21] Appl. No.: 339,999

[22] Filed: Apr. 17, 1989

[51] Int. Cl.[5] ..... B65D 83/00

[52] U.S. Cl. ..... 221/3; 221/24; 221/64; 222/78; 446/72; 446/184

[58] Field of Search ..... 221/24, 64, 3, 307, 221/303; 446/72–74, 184, 183, 369, 207; 222/78, 39, 213, 212, 215; D9/310, 317; D21/148, 150, 160

[56] References Cited

U.S. PATENT DOCUMENTS

| | | | |
|---|---|---|---|
| D. 298,145 | 10/1988 | Tsai | D20/7 |
| 868,632 | 10/1907 | Almstrom et al. | 221/24 X |
| 1,569,637 | 1/1926 | Snyder | 221/24 X |
| 2,256,340 | 9/1941 | Gora | 446/475 |
| 2,457,345 | 12/1948 | Carline | 221/64 |
| 2,479,488 | 8/1949 | Goldfard | 446/475 |
| 2,514,450 | 7/1950 | Kopf | 221/24 X |
| 2,714,275 | 8/1955 | Proll | 446/184 |
| 2,857,080 | 10/1958 | Elias | 222/213 |
| 3,230,661 | 1/1966 | Gleason | 222/192 X |
| 3,306,493 | 2/1967 | Szajna | 221/64 |
| 3,333,360 | 8/1967 | Hardy | 446/475 |
| 3,383,792 | 5/1968 | Goldfard | 446/475 |
| 3,460,286 | 8/1969 | Danberg | 446/369 X |
| 3,660,930 | 5/1972 | Indjian | 446/475 |
| 4,296,874 | 10/1981 | Evans | 221/307 |

*Primary Examiner*—David H. Bollinger
*Attorney, Agent, or Firm*—Andsel Group

[57] ABSTRACT

A candy container configured as a fowl or the like with the contained candy shaped like an egg. Squeezing or compressing the container causes an egg to be ejected from an orifice on the bottom of the container simultaneously generating air pressure to activate a reed type sound generator located in the bill of the container.

1 Claim, 1 Drawing Sheet

CANDY DISPENSER

BACKGROUND OF THE INVENTION

1. Field of the Invention

A container for egg shaped candy configured as fowl wherein the egg can be forced out a bottom orifice by squeezing or manipulating the body of the fowl to simulate the laying of an egg.

2. Description of the Prior Art

Toys and food containers shaped as an egg laying fowl are old in the prior art. Typical designs of prior art patents are shown in U.S. Pat. No. 3,333,360 Hardy, U.S. Pat No. 2,479,488 Goldfarb, U.S. Pat. No. 3,660,930 Indjian, and U.S. Pat. No. 2,256,340 Gora et al.

SUMMARY OF THE INVENTION

The instant invention describes a container in the shape of a fowl, such as a duck or the like which when compressed simulates the laying of an egg and simultaneously producing a quacking sound. The device formed of elastic or resilient material is shaped like a sitting fowl with the body cavity terminating at the bottom in an elastic slot. The egg shaped items to be dispensed are inserted into the cavity by stretching open the elastic slot. The eggs can be ejected by gently compressing the fowl which simultaneously expels air through a sound emitting element. A flexible tube extending upwards from an orifice in the top of the body cavity engages a reed type sound generator in the bill of the fowl. Compressing the ducks body generates air pressure to excite the sound generator.

DETAILED DESCRIPTION OF THE PREFERRED EMBODIMENTS

Figure 1:
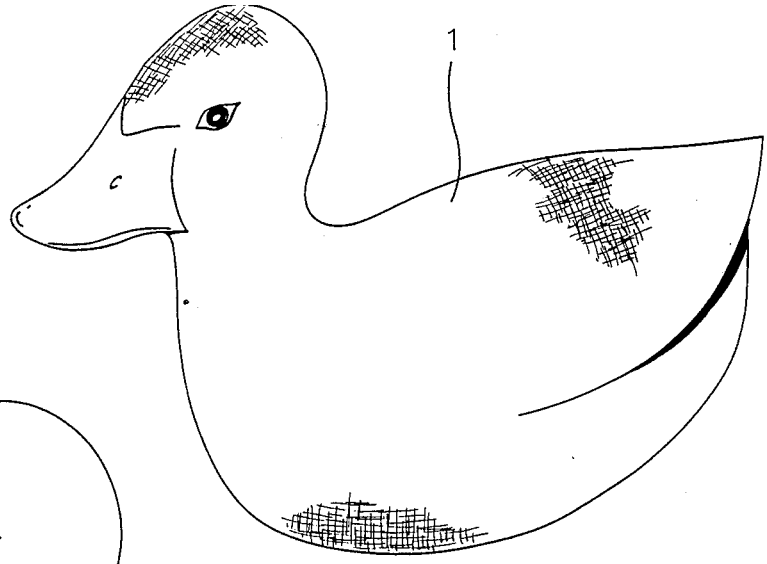
FIG 1 is a perspective view of a simulated cluck candy dispenser.
Figure 2:
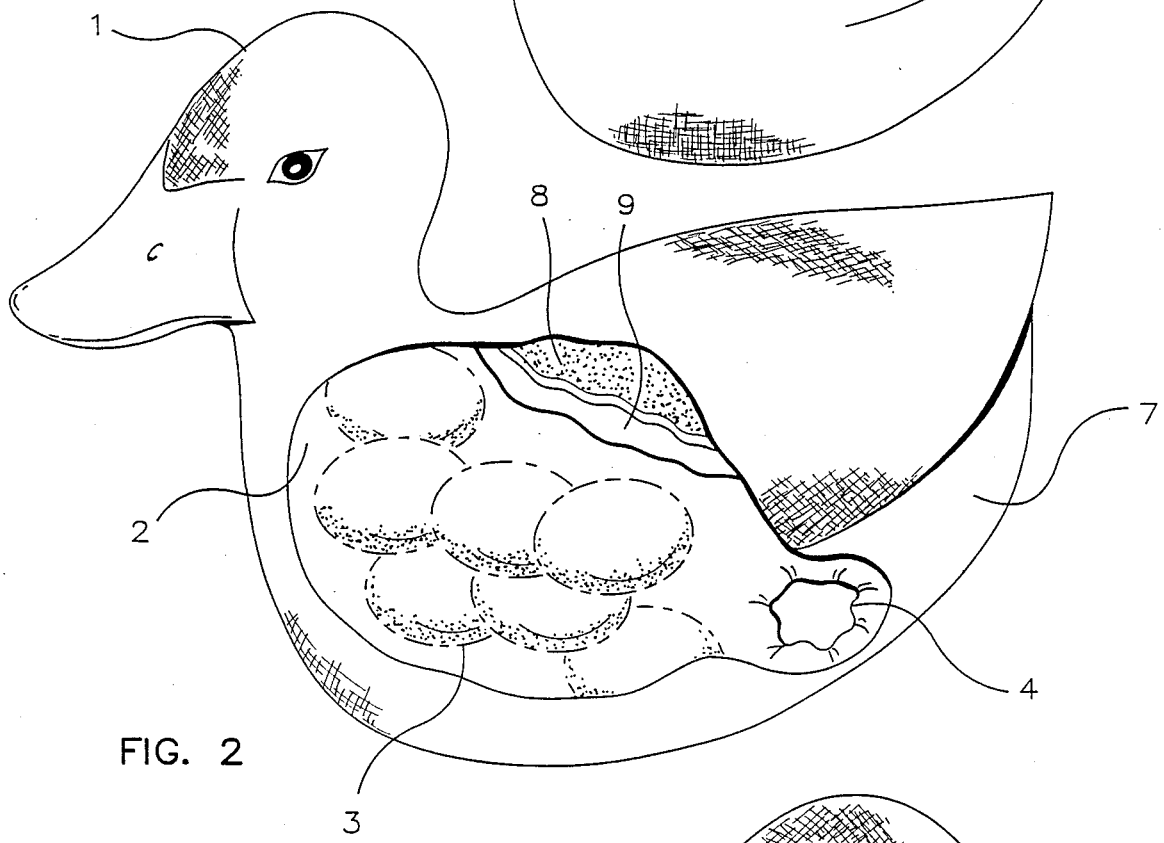
FIG. 2 is a sectionalized perspective view of the simulated duck candy dispenser.
Figure 3:
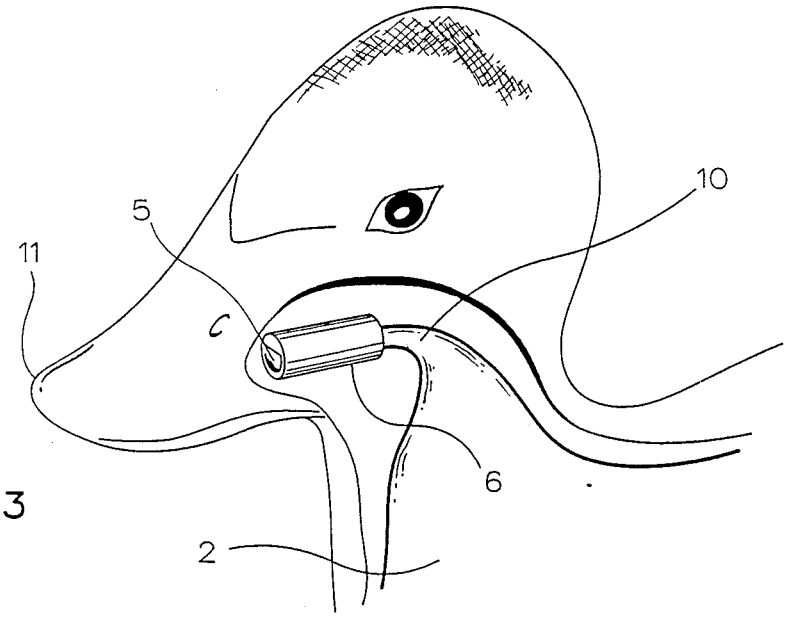
FIG. 3 is a sectional view of the sound generating element.

Referring to FIG. 1 a perspective view of the fowl 1, in this instance a duck, is shown in a sitting position. The sectional view of FIG. 2 shows the hollow resilient body 1 made of a resilient material 9 such as a rubber of rubber like foam material molded in the form of a sitting duck body with a air tight hollow inner cavity 2. The rubber like material laminated by flame bond or adhesive to an outer surface covering 8 which could range from a resilient plastic to a textured resilient material representing the feathered covering of a duck.

The hollow resilient body 1 member having two openings 4 and 5 in the wall thereof. A first opening 5 exiting the top portion of the body 1 through which a flexible tube 10 is projected from an air operable reed type sound generator 6 in the bill 11 of the duck into the interior 2 of the body and is in fixed attachment to the first opening 5. A second opening normally air tight 4 in the resilient material of the bottom of the wall of the body is formed like a diaphragm. The diaphragm opening arranged in one plane is capable of elastic distortion permitting the entering, or discharging, of egg shaped dispensbles upon being momentarily dialated.

In use compressing or squeezing the duck's body forces an egg through the closed slot 4 simultaneously generating air pressure to energize the reed type sound generator to emit a quacking sound.

We claim:

1. A candy dispenser configured as a duck formed of elastic, or resilient material, with an internal cavity filled with egg shaped edible candies through an opening in the bottom wall of the cavity wherein the improvement comprises:

(a), the outer surface of the duck covered with a resilient plastic or other resilient textured material to simulate a feathered surface;

(b), the duck body molded of a rubber-like material in the form of a sitting duck with a hollow inner cavity;

(c), the inner cavity of the duck body being air tight;

(d), the bottom wall of the inner cavity having a dialatable opening that is normally air tight; and, (e), a flexible tube exiting the top of the inner cavity extending into the bill of the duck terminating in a reed type air driven sound generator.

* * * * *